United States Patent [19]

Mulzet

[11] 4,439,178

[45] Mar. 27, 1984

[54] SEALLESS CENTRIFUGE PROCESSING CHANNEL AND TUBE SYSTEM

[75] Inventor: Alfred P. Mulzet, Princeton, N.J.

[73] Assignee: International Business Machines Corporation, Armonk, N.Y.

[21] Appl. No.: 454,904

[22] Filed: Dec. 30, 1982

[51] Int. Cl.[3] ..... B04B 11/00

[52] U.S. Cl. ..... 494/85; 494/18

[58] Field of Search ..... 494/18, 20, 16, 22, 494/27, 85; 174/86; 339/5 A

[56] References Cited

U.S. PATENT DOCUMENTS

| | | | |
|---|---|---|---|
| 2,135,835 | 11/1938 | Papello | 173/324 |
| 2,666,188 | 1/1954 | Klein | 339/5 |
| 3,358,072 | 8/1964 | Wrench | 174/86 |
| 3,775,309 | 11/1973 | Yochiro Ito et al. | 210/31 |
| 3,986,442 | 10/1976 | Khoja et al. | 74/797 |
| 4,056,224 | 11/1977 | Lolachi | 233/14 |
| 4,111,356 | 9/1978 | Boggs | 494/18 |
| 4,113,173 | 9/1978 | Lolachi | 494/18 |
| 4,114,802 | 9/1978 | Brown | 233/26 |
| 4,120,448 | 10/1978 | Cullis | 233/22 |
| 4,146,172 | 3/1979 | Cullis et al. | 233/26 |
| 4,221,322 | 9/1980 | Drago et al. | 233/23 |
| 4,261,507 | 5/1981 | Bäumler | 233/23 |
| 4,372,484 | 2/1983 | Larsson | 494/18 |

*Primary Examiner*—Robert W. Jenkins
*Attorney, Agent, or Firm*—Carl C. Kling

[57] ABSTRACT

The disclosure is a disposable low-mass processing channel and multilumen tube system for operation with a 2ω sealless centrifuge in which the centrifuge rotor rotates at 2ω axially to a platform rotor rotating at 1ω and to a fixed axial clamp on the multilumen tube.

The blood processing channel is equipped with several tube lumens for access to different blood fractions to be separated by the centrifuge action. The plastic lumen tube is supported at each end by plastic reinforcing tubes clamped at clamp ends and ending in thrust drive bearings at the free ends. The thrust drive bearings are arranged for rotation about the multilumen tube and for fixation with respect to slotted conical reinforcing tube receivers on the 1ω rotor.

Centrifugal force fixes the thrust bearings in place within the slotted conical reinforcing tube receivers. The low-mass central portion of the multilumen tube is unsupported; in operation it flies free in a wide bend. The multilumen tube is easily placed in position in the slots of the reinforcing tube receivers of the centrifuge rotor, by side-entry, and are subsequently held in place by the beam strength of the flexed reinforcing tubes and by centrifugal force.

5 Claims, 4 Drawing Figures

SEALLESS CENTRIFUGE PROCESSING CHANNEL AND TUBE SYSTEM

BACKGROUND OF THE INVENTION

1. Field of the Invention

The invention relates to continuous flow sealless centrifuge processing systems used for human blood or other separable fluid suspensions, and further relates to a partially supported integral processing channel and tube system which is inexpensive, easy to load, and capable of withstanding the forces involved in centrifuge operation.

2. Description of the Prior Art

There are a number of blood centrifuge devices available. These blood centrifuges may be characterized as 2ω-centrifuge-rotor-on-1ω-platform-rotor centrifuges (or as 2ω centrifuges). In sealless 2ω centrifuges, the supply tube is held in a stationary position axial to the centrifuge 2ω rotor and to the center of rotation of the centrifuge 1ω platform rotor. The supply tube flexes as it follows the 1ω 1 rotor about the 1ω rotor axis and simultaneously the centrifuge 2ω rotor rotates at 2ω. During centrifuge operation the supply tube flexes with only partial rotation while other parts rotate around it.

Blood centrifuges may operate with a number of separable supply tubes (or tube channels known as lumens) in order to process various blood components. Such multilumen centrifuge systems normally require either a multichannel rotating seal, such as used with the IBM 2997 Blood Separation Channel, or are limited to relatively low rotational speeds to eliminate the destructive heat associated with rotational and flexure friction.

U.S. Pat. No. 4,114,802, R. I. Brown, "Centrifugal Apparatus with Biaxial Connector" shows a connection member driven synchronously with the rotation of tubing or umbilical cable about its own axis.

U.S. Pat. No. 3,986,442, Khoja et al, "Drive System for a Centrifugal Liquid Processing System" shows a guide tube rotating at −ω which is used to minimize friction between the guide tube and the cable. The guide tube has its axis parallel to the system axis.

U.S. Pat. No. 4,056,224, H. Lolachi, "Flow System for Centrifugal Liquid Processing Apparatus," shows a 2ω sealless centrifuge in which the supply tube is essentially unsupported except for guide members which provide positioning with respect to the rotor. FIG. 8 of the same patent shows a guide tube which is provided as a loading guide for insertion of a loading cord. The loading cord is pulled through the guide tube and in turn pulls the blood bag into the centrifuge bowl.

U.S. Pat. No. 4,113,173, Lolachi, "Centrifugal Liquid Processing Apparatus," shows a blood centrifuge type in which the multiple supply tube is supported loosely during operation by a bail and roller on the rotor.

U.S. Pat. No. 3,358,072, E. R. Wrench, "Coupling," shows a hollow shaft and hollow bevel gear arrangement by which a supply tube is coupled to a 2ω sealless centrifuge.

U.S. Pat. No. 2,135,835, K. Papello, "Device for Transmitting Electric Currents," shows a somewhat similar device by which a set of electrical cables is connected to a rotor within a rotating bowl.

None of the prior art centrifuge descriptions, taken individually or together, illustrate a partially self-supporting processing channel, and tube system with support for the tube other than by threading the tube through support bearings.

SUMMARY OF THE INVENTION

The invention is a limited use, inexpensive, partially self-supporting processing channel and tube system for use with a 2ω sealless centrifuge. Such a limited use system is especially valuable in sterile applications related to human blood separation activities with the patient or donor "on the system" contributing or receiving a blood fraction while connected with a significant flow of blood through the system and back to the patient or donor.

In a 2ω sealless centrifuge, the limited use processing channel and lumen tube system is mounted with the processing collar formed on a centrifuge rotor which is rotating at 2ω on a platform rotor rotating at 1ω. The lumen tube is prevented from twisting by driving it, by the rotor, in the same direction as the centrifuge 2ω rotor around the 2ω rotor, at a speed of 1ω. As a result, the lumen tube flexes about its own axis in the direction of the processing channel and 2ω rotor rotation at a speed of −1ω with respect to a support bearing on the periphery of the 1ω rotor. The lumen tube encounters stresses due to centrifugal force and due to drive forces from two drive bearing support points on the 1ω rotor. The unreinforced central portion of the lumen tube, supported by centrifugal force, extends in two reinforced portions, the first between the processing channel clamp on the 2ω rotor and a first bearing support point on the 1ω rotor, and the second between the stationary clamp and a second bearing support point on the 1ω rotor. In the reinforced portions, the lumen tube is mounted within a surrounding reinforcing sleeve. Lumen tube and reinforcing sleeve flex as a unit. The processing channel and clamp are fixed axially to the 2ω rotor so as to rotate with the 2ω rotor. The 1ω rotor, a support platform and bail rotating at 1ω, includes a pair of reinforcing sleeve receivers at the bearing support points. The reinforcing sleeves end in reinforcing sleeve thrust drive bearings, with each of the reinforcing sleeve portions extending between a clamp and the respective reinforcing sleeve thrust drive bearing. The respective thrust drive bearings mate with related reinforcing sleeve receivers on the 1ω rotor. Each reinforcing sleeve receiver has a slot, of sufficient size with respect to the expected unsupported lumen tube, to allow side entry of the lumen tube but not of the reinforcing sleeve or thrust drive bearing. When mounted in the centrifuge drive, the lumen tube flexes freely between the reinforcing sleeve receivers, while the 2ω rotor turns. The lumen tube flexes but does not actually rotate a complete revolution. The processing channel may be served by multiple lumens so as to provide multiple separation operations during the same spin as required by blood fractionating processes. The lumen tube within each of the two reinforcing tubes flexes less freely because of the constraints of the reinforcing sleeves which are clamped in a stressed curve in relationship to their respective reinforcing tube receivers and their respective clamps.

The object of the invention is to provide partial self-support in a limited use processing channel and lumen tube system in which the lumen tube is supported by limited use reinforcing sleeves with their own limited use thrust drive bearings.

An object of the invention is to provide an inexpensive, easy to use limited use sterile blood centrifuge processing channel and tube system which can withstand the enormous forces of centrifuge operations.

Another object of the invention is to provide a centrifuge processing channel and tube system with an included set of reinforcing sleeves having thrust drive bearings so that there is no requirement to thread any part of the system through any thrust drive bearings when loading or unloading the system onto a centrifuge.

DESCRIPTION OF THE PREFERRED EMBODIMENT

Figure 1:
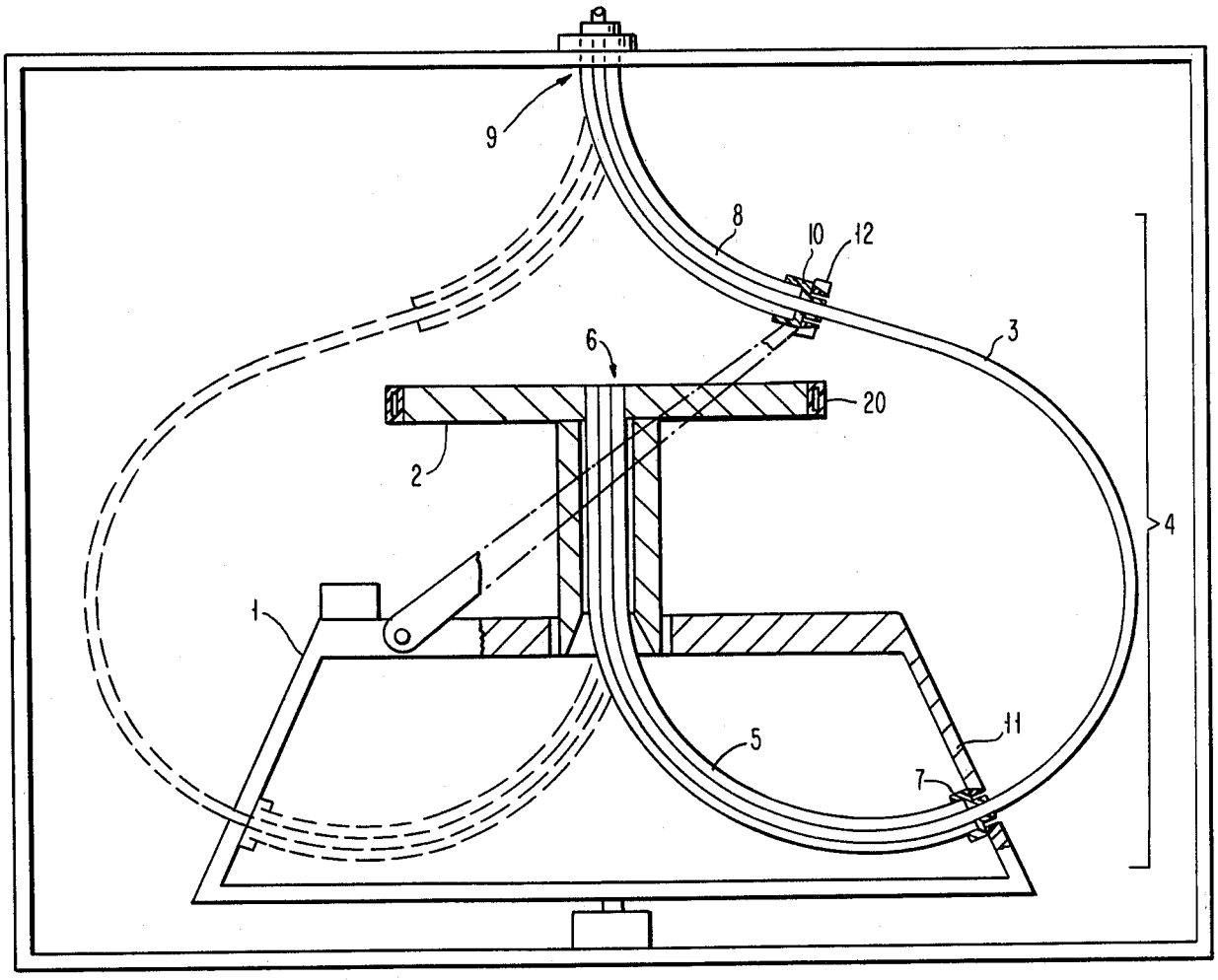
FIG. 1 is a system drawing showing the limited use partially self-supporting processing channel and tube system in a sealless 2ω centrifuge drive.

FIG. 1 shows the limited use partially self-supported processing channel and tube system in place in a 2ω sealless centrifuge drive. The centrifuge drive includes 1ω rotor 1, which carries 2ω rotor 2, supplied by the processing channel and tube system. The processing channel and tube system includes lumen tube portion 3 and other components which form the system 4. Lumen tube 3 is supported by a first reinforcing sleeve 5 between processing channel clamp point 6 and thrust drive bearing 7. Lumen tube 3 is also supported by a second reinforcing sleeve 8 mounted between stationary clamp point 9 and thrust drive bearing 10 which is arranged to move with 1ω rotor 1. The first reinforcing sleeve 5 (thrust drive bearing 7) fits in reinforcing sleeve receiver 11 on 1ω rotor 1 while the second reinforcing sleeve 8 (thrust drive bearing 10) fits in reinforcing sleeve receiver 12 at another point on 1ω rotor 1.

In operation, 1ω rotor 1 is provided with a 1ω spin by means not shown and the 2ω rotor 2 is provided with a 2ω spin in the same direction by means not shown. The lumen tube 3 merely flexes with its reinforcing sleeves 5 and 8, with a portion of the lumen tube configured by centrifugal force in the otherwise unsupported portion between reinforcing sleeve receivers 11 and 12.

General characteristics of the 2ω sealless centrifuge are merely context for the invention, although the 1ω rotor must be configured with appropriate reinforcing sleeve receivers to fit the limited use partially self-supported processing channel and tube system of the invention.

Figure 2:
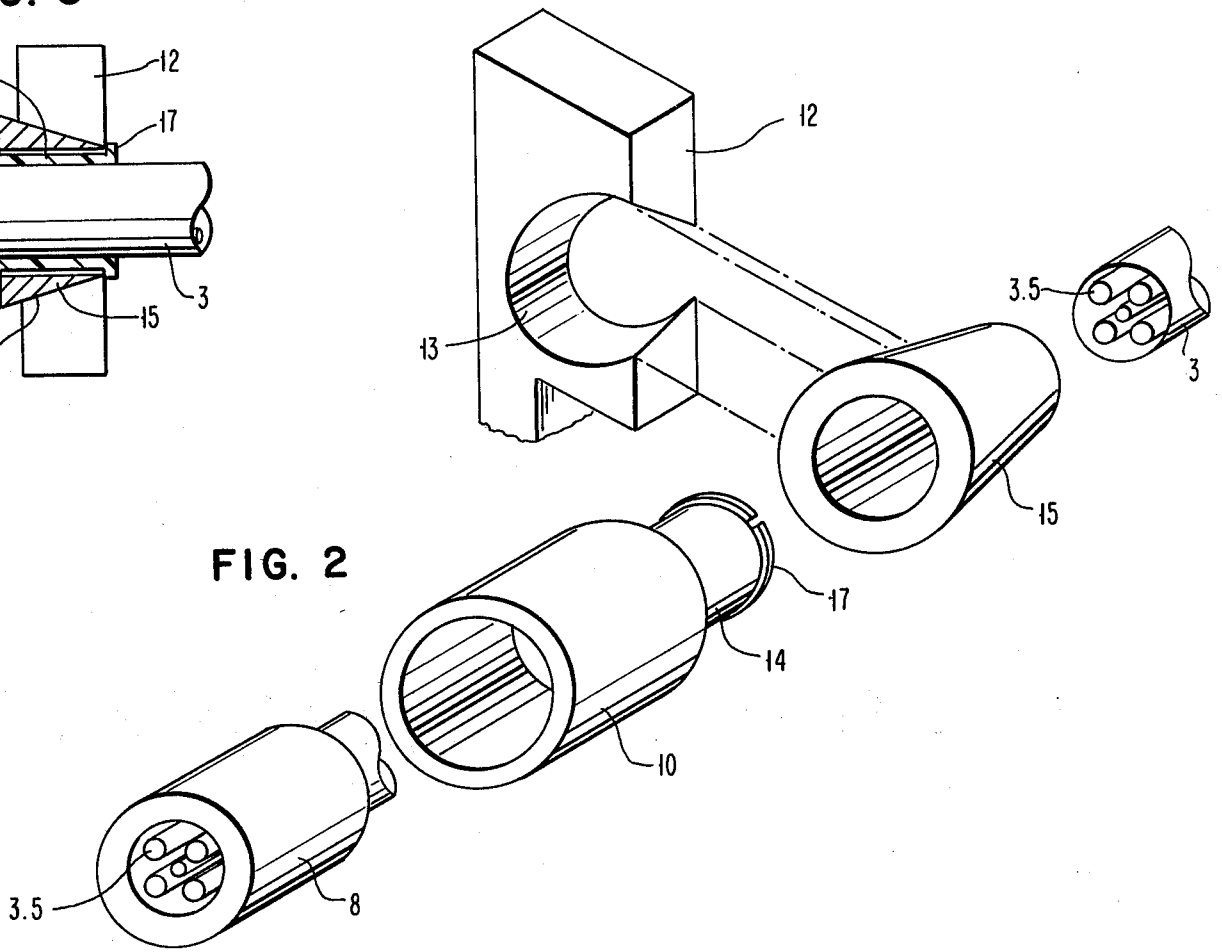
FIG. 2 is an exploded and partially cutaway detail diagram illustrating the relationships between the centrifuge drive and the system, showing the lumen tube and the reinforcing sleeves with their thrust drive bearings.

FIG. 2 is a partially cutaway detail diagram illustrating the relationships between the limited use, partially self-supporting processing channel and tube system and the reinforcing sleeve receiver of the centrifuge drive.

Figure 3:
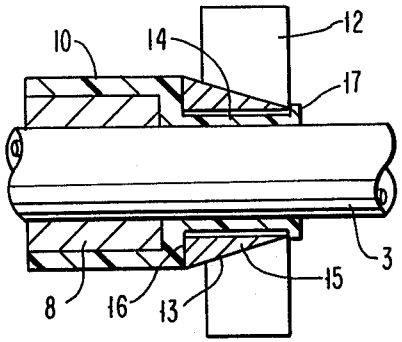
FIG. 3 is a detail diagram of the reinforcing sleeve thrust drive bearing in place in the reinforcing sleeve receiver.

FIG. 3 shows detail of one of the reinforcing sleeve thrust drive bearings (second thrust drive bearing 10). Lumen tube 3 is supported by second thrust drive bearing 10 and by second reinforcing sleeve 8, which is press fit with its outside diameter slightly smaller than the inside diameter of the housing of bearing 10. Cement may be used as required.

Drive power is imparted by second reinforcing sleeve receiver 12 in the direction normal to the page; receiver 12 and slotted coneholder 13 at the same time fix reinforcing sleeve 8 longitudinally because of the beam strength of reinforcing sleeve 8 and because of centrifugal force. Lumen tube 3 is fixed to reinforcing sleeves 5 and 8 at thrust drive bearings 7 and 10, respectively, by cement of sufficient strength to prevent rotation of lumen tube 3 inside the reinforcing sleeves 5 and 8. Lumen tube 3 includes a number of included smaller tubes or bores (lumens) appropriate for the desired separation functions. The cutaway of FIG. 2 shows five lumens, of which only lumen 3.5 is identified.

Drive forces are imparted through axle surface 14 of thrust drive bearing 10 from drive bearing slider cone 15; it is urged by centrifugal force and by pressure of thrust bearing surface 16 urged by the compression of reinforcing sleeve 8 to a snug fit within slotted coneholder 13. A small lip forms bearing cone retainer 17.

Note that these inexpensive bearings (7,10, FIG. 1) are to be operated at speeds of 1ω, which in the preferred embodiment may be 1200 rpm. Centrifugal forces of approximately 1,000 G are effective at the processing channel; forces of greater than 250 G act at the bearing as a result of centrifugal force alone. Other bearing load comes from the continual flexing which is not without aberration both cyclical and random. Initial sterilization makes hydrocarbon lubrication inappropriate, and especially heat from operational friction (both rotational and flexure) are significant. The plastic reinforcing sleeves (5, 8, FIG. 1) are a source of heat due to flexure friction; they are not effective to cool the bearings. The bearing slider cones (15, FIGS. 2 and 3) are most effectively cooled by good contact to their respective coneholders (13, FIGS. 2 and 3). The cones are preferably of a good heat transfer material such as aluminum. Note that air cooling of the coneholder is inherent because of the centrifuge rotation, but the normal heat buildup within the centrifuge housing may keep even the cooling air at an elevated temperature. Bearing slider external configurations other than conical can be used, with appropriate complementary configurations of the coneholder, but conical configuration is preferred.

The lumen tube 3 itself heats up due to flexure friction. The reinforcing sleeves (5,8) control this flexure within bounds, and distribute the flexure and also the heat so as to avoid weakened hot spots. The unsupported medial portion of lumen tube 3 is air cooled and also is relatively free from aberrations. It flexes freely in rotational mode (partial rotations) but is held by enormous G-forces in a smooth curve between the two thrust drive bearings.

Figure 4:
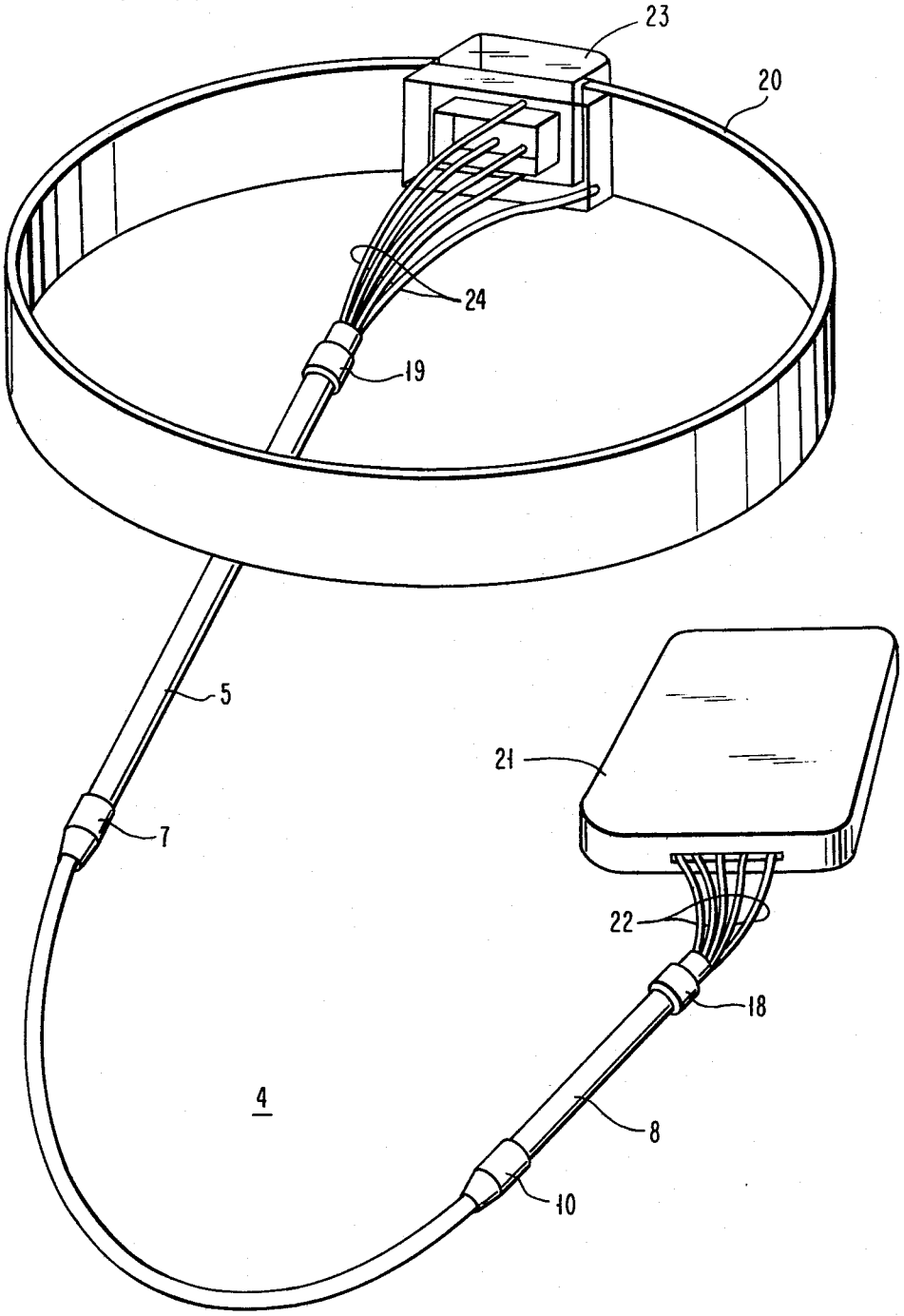
FIG. 4 is a diagram of the limited use processing channel and tube system of the invention.

FIG. 4 illustrates the limited use, inexpensive, partially self-supporting processing channel and tube system for use in a 2ω sealless centrifuge. Locator rings 18 and 19 affixed to the respective reinforcing sleeves 5 and 8 are available for clamping by clamps (6 and 9, FIG. 1) of the centrifuge drive.

Processing channel 20 is arranged to fit on the 2ω rotor (2, FIG. 1) for high speed rotation at 2ω, in the preferred embodiment 2400 rpm. Processing channel 20 may be compressed, to facilitate its passage up through an axial opening of the 2ω rotor, and then it may be opened for placement as a ring about the periphery of the 2ω rotor as shown in FIG. 1.

Thrust drive bearings 7 and 10 are arranged to fit reinforcing tube receivers 11 and 12, respectively. Distribution plumbing 21, distribution lumen tube separations 22, and processing manifold 23 with its lumen tube separations 24 are configured appropriately for the desired separations. Where appropriate, further plumbing within the closed system can be integrated in distribution plumbing 21. The further plumbing normally includes tubes for use with peristaltic pumps and input and output tubes. Processing manifold 23 can take a number of different forms as desired. Connections for saline solutions for precharge and other uses may also be integrated.

The system in the preferred embodiment is configured of the following materials:

Lumen tubes—polyvinyl chloride

Reinforcing tubes—polyvinyl chloride

Thrust drive bearings—acetal plastic packed with polyester for lubrication

Bearing cone—aluminum.

Other materials, dimensional variations and appropriate selection of fractionating choices may be substituted. Note that the plastic parts are subjected, during their relatively short duration of actual use (minutes or hours) to temperature changes from room temperature to high frictional heat, to forces of from 1 to 1,000 G and pressures up to 8 kilograms per square centimeter.

What is claimed is:

1. A limited use $2\omega$ sealless centrifuge processing member and tube systems, in which a processing channel is clamped to a lumen tube which interconnects to nonrotating support structure via a stationary clamp—characterized—

(a) a processing member;

(b) a lumen tube operatively connected to said processing member, having a processing member end and a stationary clamp end;

(c) a first reinforcing tube encasing a first portion of said lumen tube at the processing member end, having also a free end;

(d) a second reinforcing tube encasing a second portion of said lumen tube at the stationary clamp end, having also a free end;

(e) a first reinforcing tube thrust drive bearing at the free end of said first reinforcing tube; and (f) a second reinforcing tube thrust drive bearing at the free end of said second reinforcing tube;

whereby the system may be mounted in a $2\omega$ sealless centrifuge with a minimum of threading and with portions of said lumen tube supportable by said reinforcing tubes and thrust drive bearings during centrifuge operation.

2. The system according to claim 1, where the free ends of said reinforcing tubes are cemented to the respectively included lumen tubes.

3. The system, according to claim 1, wherein said first and second thrust drive bearings each comprise a bearing slider and a housing having socket, thrust bearing surface, axle bearing surface and retainer, and are made of low friction material, said housing is mounted with the respective reinforcing sleeve free end fixed in its socket and with said bearing slider mounted on said axle bearing surface in contact with said thrust bearing surface and retained in place by said retainer.

4. A partially self-supported processing member and tube system according to claim 3, in which said bearing sliders are conical in configuration, with the point of the cone in the direction of expected centrifugal force.

5. A partially self-supported processing member and tube system according to claim 1,—further characterized by— a first locator integral with said first reinforcing sleeve at a finite distance from said first thrust drive bearing along said first reinforcing sleeve; and a second locator integral with said second reinforcing sleeve at a finite distance from said second thrust drive bearing along said second reinforcing sleeve;

whereby when mounted in a $2\omega$ centrifuge of appropriate dimensions said first reinforcing sleeve may be constrained in an appropriate bend by compression between the processing channel clamp and the first reinforcing sleeve retainer of the $2\omega$ centrifuge and said second reinforcing sleeve may be constrained in an appropriate bend by compression between the second reinforcing sleeve receiver and the stationary clamp of the $2\omega$ centrifuge.

* * * * *

UNITED STATES PATENT AND TRADEMARK OFFICE

CERTIFICATE OF CORRECTION

PATENT NO. : 4,439,178

DATED : March 27, 1984

INVENTOR(S) : Alfred P. Mulzet

It is certified that error appears in the above-identified patent and that said Letters Patent is hereby corrected as shown below:

Column 5, line 28, Claim 1, "systems" should read --system--.

Column 5, line 31, Claim 1, "characterized" should read --characterized by--.

Signed and Sealed this

*Sixteenth* Day of *July 1985*

[SEAL]

*Attest:*

DONALD J. QUIGG

*Attesting Officer* *Acting Commissioner of Patents and Trademarks*